US006928826B2

(12) United States Patent
Lee et al.

(10) Patent No.: US 6,928,826 B2
(45) Date of Patent: Aug. 16, 2005

(54) METHOD FOR CONTROLLING NOISE REDUCTION OF AIR CONDITIONER

(75) Inventors: Won Hee Lee, Seoul (KR); Cheol Min Kim, Anyang-si (KR); Yoon Jei Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/718,783

(22) Filed: Nov. 20, 2003

(65) Prior Publication Data

US 2004/0098992 A1 May 27, 2004

(30) Foreign Application Priority Data

Nov. 22, 2002 (KR) ..... 10-2002-0073110

(51) Int. Cl.[7] ..... G05D 23/32; F25D 17/00; F25D 19/00

(52) U.S. Cl. ..... 62/158; 62/181; 62/228.1; 62/296

(58) Field of Search ..... 62/157, 158, 180, 62/181, 186, 228.1, 228.5, 296

(56) References Cited

U.S. PATENT DOCUMENTS 5,400,611 A * 3/1995 Takeda et al. ..... 62/158

2002/0144510 A1 * 10/2002 Park et al. ..... 62/186

FOREIGN PATENT DOCUMENTS

JP 58127038 A * 7/1983 ..... F24F/11/02

JP 58158441 A * 9/1983 ..... F24F/11/02

* cited by examiner

*Primary Examiner*—Marc Norman

(74) *Attorney, Agent, or Firm*—Lee, Hong, Degerman, Kang & Schmadeka

(57) ABSTRACT

Disclosed is a method for controlling noise reduction of an air conditioner comprising the steps of: (a) stopping a compressor, when the air conditioner is stopped under the condition that the compressor and an outdoor fan are operated; and (b) stopping the outdoor fan after a designated time after a point in time when the compressor is stopped in the step (a) elapses, thus reducing the size and duration of noise generated by the flow of the refrigerant due to a difference of inner pressures in the air conditioner and allowing the noise at a designated frequency band generated by the flow of the refrigerant, which causes unpleasantness to users, to be concealed by noise generated by the operation of the outdoor fan. Accordingly, the method of the present invention increases reliability of air conditioner products.

4 Claims, 4 Drawing Sheets

METHOD FOR CONTROLLING NOISE REDUCTION OF AIR CONDITIONER

BACKGROUND OF THE INVENTION

1. Field of the Invention

The present invention relates to a method for controlling noise reduction of an air conditioner, and more particularly to a method for controlling noise reduction of an air conditioner, in which an outdoor fan is continuously operated under the condition that a compressor is stopped, thus reducing noise generated due to flow of a refrigerant when the compressor is stopped.

2. Description of the Related Art

Generally, an air conditioner, serving as a cooler, a heater and/or an air cleaner, is an appliance for cooling, heating and/or cleaning indoor air, thus providing a comfortable indoor environment.

FIG. 1 is a schematic view of a conventional air conditioner operated in a cooling cycle, and FIG. 2 illustrates graphs respectively showing operating states of a compressor and an outdoor fan when the conventional air conditioner is stopped.

As shown in FIG. 1, the conventional air conditioner, operated in the cooling cycle, comprises a compressor 2 for compressing a refrigerant into a high-tempereature and high-pressure gaseous state, a condenser 4 for condensing the refrigerant passing through the compressor 2 into a medium-temperature and high-pressure liquid state, an expansion device 6 for decompressing the refrigerant passing through the condenser 4 into a low-temperature and low-pressure liquid state, and an evaporator 8 for evaporating the refrigerant passing through the expansion device 6 into a low-temperature and low-pressure gaseous state. Here, the compressor 2, the condenser 4, the expansion device 6 and the evaporator 8 are connected by a refrigerant pipe.

In the air conditioner operated in the cooling cycle, an outdoor fan 12 for blowing outdoor air is installed adjacent to the condenser 4, and an indoor fan 14 for blowing indoor air is installed adjacent to the evaporator 8. Such an air conditioner is controlled by a control unit.

Hereinafter, operation of the above-described conventional air conditioner will be described in detail.

First, when the air conditioner is started, the compressor 2 is operated, and then the refrigerant circulates along the compressor 2, the condenser 4, the expansion device 6 and the evaporator 8, sequentially. Here, the outdoor fan 12 and the indoor fan 14 are operated. Accordingly, the refrigerant passing through the condenser 4 is heat-exchanged with the outdoor air blown by the outdoor fan 12, and is then condensed. Further, the refrigerant passing through the evaporator 8 is heat-exchanged with the indoor air blown by the indoor fan 14, thus cooling the indoor air.

When the air conditioner is stopped, as shown in FIG. 2, power, which is provided to the compressor 2 and the outdoor fan 12, is switched off, thus simultaneously stopping the compressor 2, the outdoor fan 12 and the indoor fan 14.

When the air conditioner is stopped as described above, the refrigerant flows from the compressor 2 and the condenser 4, having comparatively high inner temperature and pressure, to the expansion device 6 and the evaporator 8, having comparatively low inner temperature and pressure, until the inner pressures of the compressor 2, the condenser 4, the expansion device 6 and the evaporator 8 reach an equilibrium state.

When the air conditioner is stopped, the compressor 2 and the outdoor fan 12, etc. are all stopped. Accordingly, the refrigerant flows from the compressor 2 and the condenser 4, having comparatively high inner temperature and pressure, to the expansion device 6 and the evaporator 8, having comparatively low inner temperature and pressure, thus generating noise. Particularly, the noise generated due to the flow of the refrigerant, has a designated frequency band, and is transmitted into an indoor space along the refrigerant pipe, thus causing indoor users to experience an unpleasant noise.

SUMMARY OF THE INVENTION

Therefore, the present invention has been made in view of the above problems, and it is an object of the present invention to provide a method for controlling noise reduction of an air conditioner, in which an outdoor fan is continuously operated even when a compressor is stopped, so that the pressure of a refrigerant discharged from a condenser is rapidly lowered, thus reducing noise generated due to flow of the refrigerant when the air conditioner is stopped.

In accordance with one aspect of the present invention, the above and other objects can be accomplished by the provision of a method for controlling noise reduction of an air conditioner, comprising the steps of: (a) stopping a compressor, when the air conditioner is stopped under the condition that the compressor and an outdoor fan are operated; and (b) stopping the outdoor fan after a designated time after a point in time when the compressor is stopped in the step (a) elapses.

Preferably, the designated time in the step (b) may be a time required to allow inner pressures of the compressor, a condenser, an expansion device and an evaporator to reach an equilibrium state.

In accordance with another aspect of the present invention, there is provided a method for controlling noise reduction of an air conditioner, in which an outdoor fan is continuously operated for a designated time after a compressor is stopped, so as to reduce temperature and pressure of a refrigerant passing through a condenser.

Preferably, the outdoor fan may be stopped after the designated time from the stoppage of the compressor elapses, and the designated time may be a time required to allow inner pressures of the compressor, a condenser, an expansion device and an evaporator to reach an equilibrium state.

The method of the present invention continuously operates the outdoor fan for the designated time after the stoppage of the compressor, so as to rapidly reduce the pressure of the refrigerant passing through the condenser having a comparatively high inner pressure, thus reducing the size and duration of noise generated by the flow of the refrigerant due to a difference of inner pressures in the air conditioner and allowing the noise at a designated frequency band generated by the flow of the refrigerant, which causes unpleasantness to users, to be concealed by noise generated by the operation of the outdoor fan. Accordingly, the method of the present invention increases reliability of air conditioner products.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be described in detail with reference to the annexed drawings.

Figure 3:
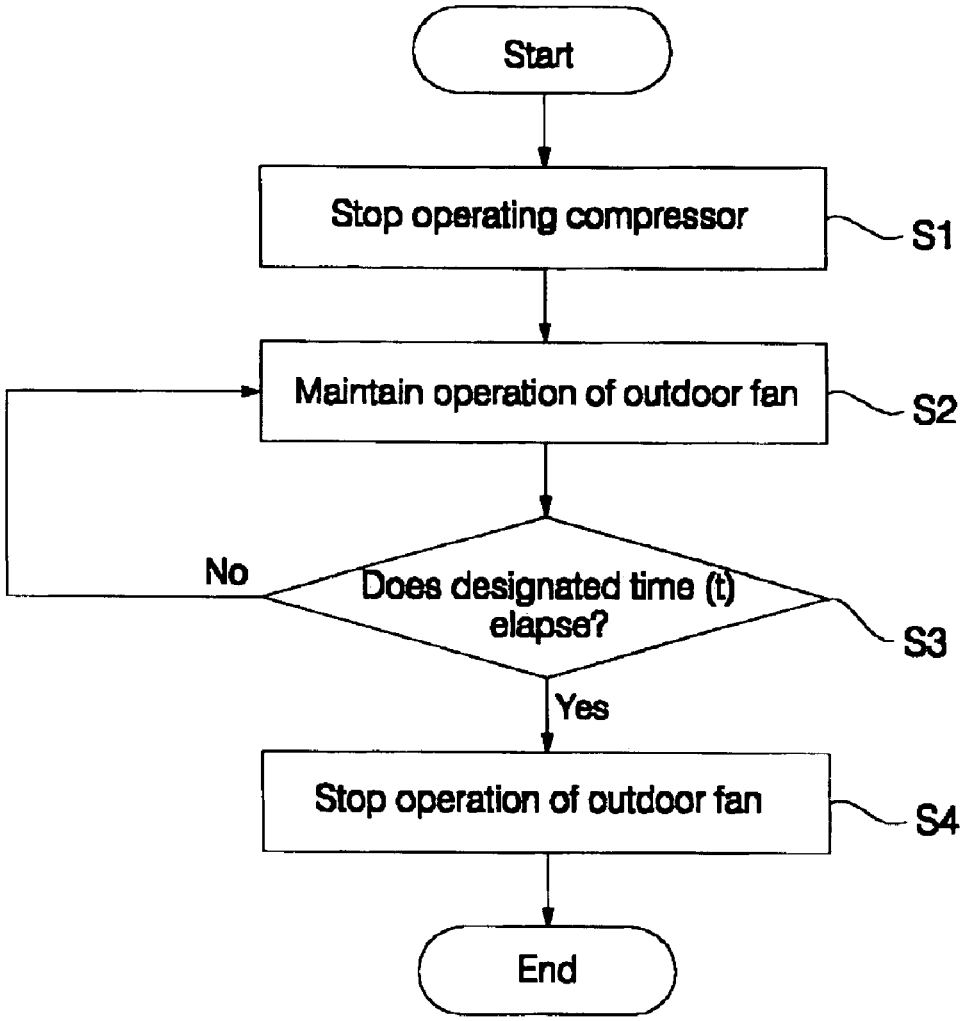
FIG. 3 is a flow chart illustrating a method for controlling noise reduction of an air conditioner in accordance with the present invention.
Figure 4:
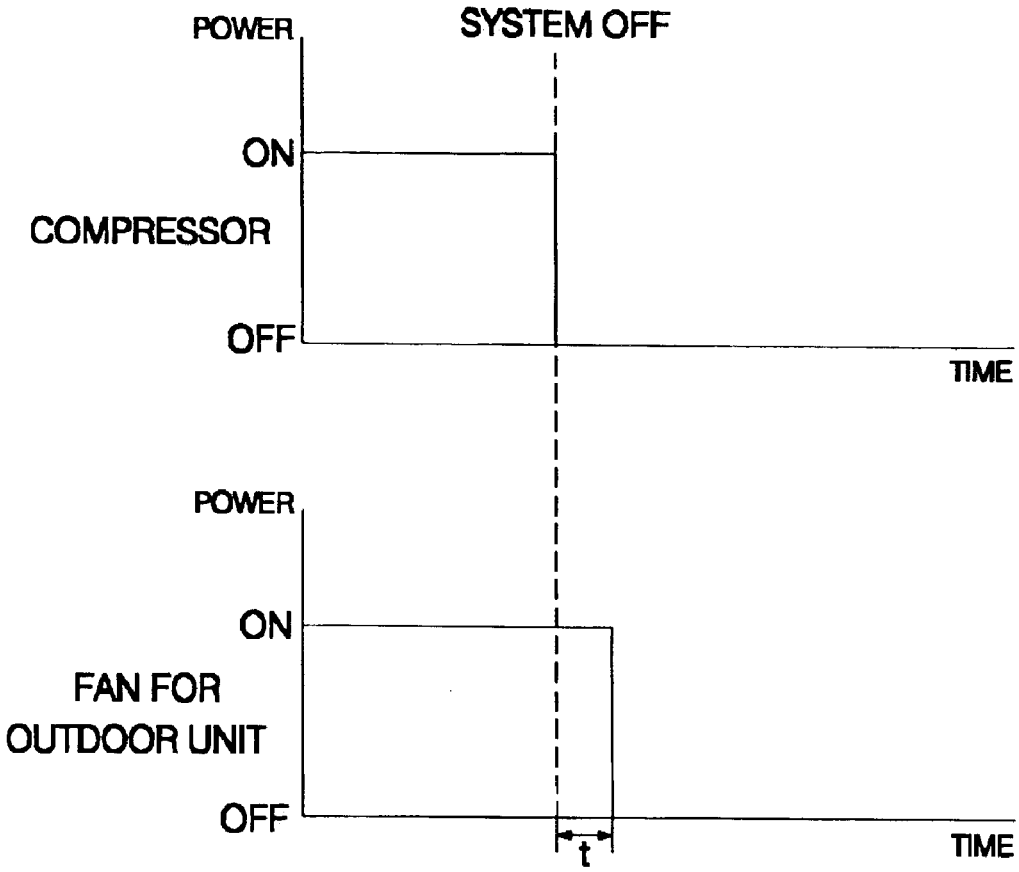
FIG. 4 illustrates graphs respectively showing power supply states provided to a compressor and an outdoor fan when the air conditioner of the present invention is stopped.

FIG. 3 is a flow chart illustrating a method for controlling noise reduction of an air conditioner in accordance with an embodiment of the present invention, and FIG. 4 illustrates graphs respectively showing power supply states provided to a compressor and an outdoor fan when the air conditioner of the present invention is stopped.

Figure 1:
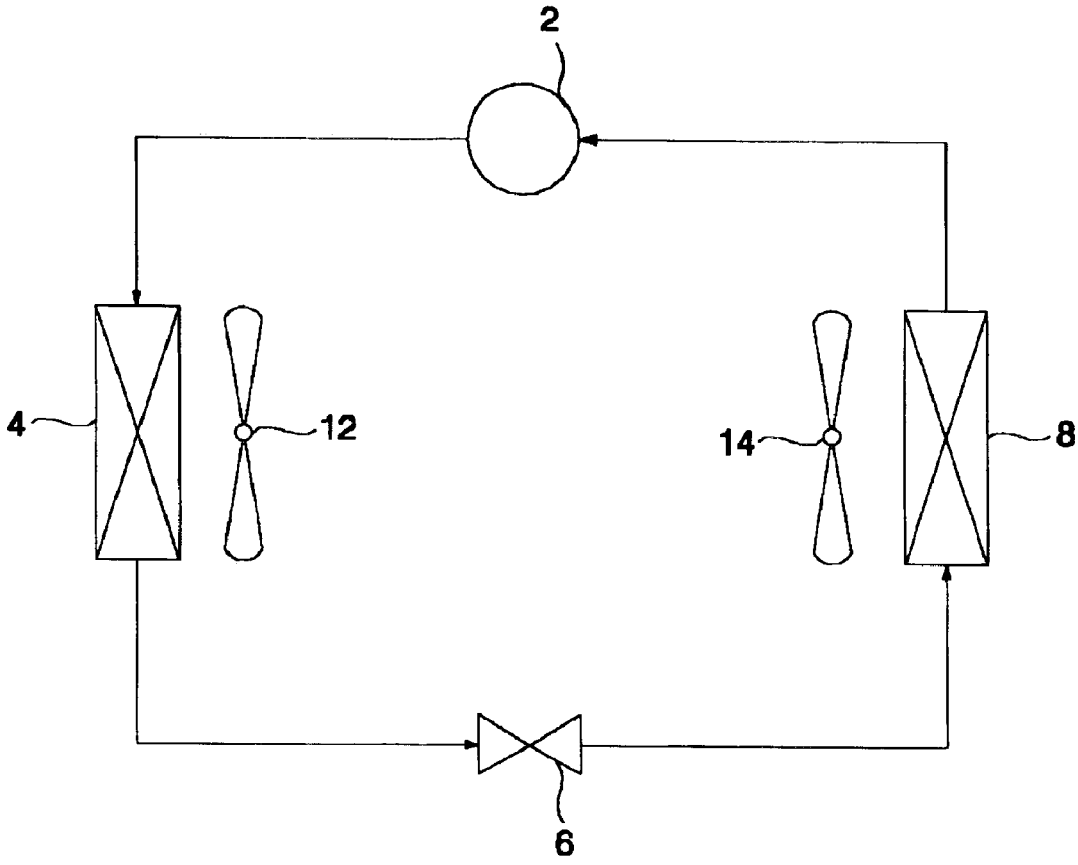
FIG. 1 (Prior Art)
FIG. 1 is a schematic view of a conventional air conditioner in a cooling cycle.
Figure 2:
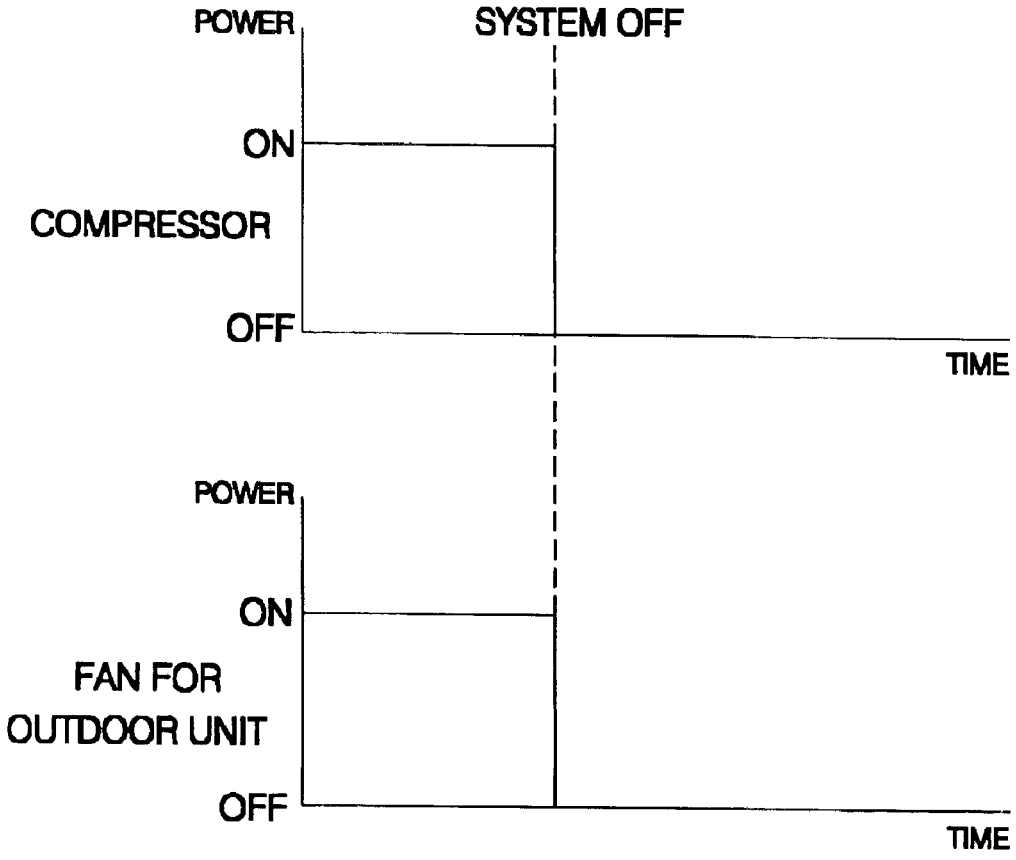
FIG. 2 (Prior Art)
FIG. 2 illustrates graphs respectively showing power supply states provided to a compressor and an outdoor fan when the conventional air conditioner is stopped.

Hereinafter, the method for controlling noise reduction of an air conditioner in accordance with the present invention will be described with reference to FIGS. 1 and 3.

When the air conditioner is stopped, the compressor 2, which is operating, is stopped (S1).

Generally, when the air conditioner is operated, power is supplied to the air conditioner by a user's manipulation, and then the compressor 2 is operated until an indoor temperature reaches a target temperature. Here, a refrigerant circulates along the compressor 2, the condenser 4, the expansion device 6 and the evaporator 8, sequentially. Simultaneously, the outdoor fan 12 is operated so as to blow outdoor air toward the condenser 4, and the indoor fan 14 is operated so as to blow indoor air toward the evaporator 8.

The flow of the refrigerant is carried out not only by the operation of the compressor 2 but also by the difference of the inner pressures in the refrigerant pipes generated by the comparatively high inner pressure and temperature of the compressor 2 and the condenser 4 and the comparatively low inner pressure and temperature of the expansion device 6 and the evaporator 8.

However, when the indoor temperature reaches the target temperature or power supplied to the air conditioner is shut off, the compressor 2 and the indoor fan 14 are stopped.

Then, the outdoor fan 12 maintains its operation even when the compressor 2 is stopped (S2).

Here, even when the compressor 2 is stopped, the refrigerant flows from the compressor 2 and the condenser 4, having comparatively high inner temperature and pressure, to the expansion device 6 and the evaporator 8, having comparatively low inner temperature and pressure. However, in the present invention, even when the compressor 2 is stopped, the outdoor fan 12 is continuously operated, thus allowing the refrigerant passing through the condenser 4 to be heat-exchanged with outdoor air and reducing the inner temperature and pressure of the condenser 4.

Accordingly, the difference between the inner pressures of the compressor 2 and the condenser 4 and the inner pressures of the expansion device 6 and the evaporator 8 is reduced, and then the flow rate of the refrigerant is decreased, thus reducing noise generated due to the flow of the refrigerant, allowing the inner pressures of the cooling cycle to rapidly reach an equilibrium state, and shortening noise generating duration.

Thereafter, it is determined whether a designated time (t) of the operation of the outdoor fan 12 after a point in time when the compressor 2 is stopped elapses. In case that the designated time (t) has elapsed, the outdoor fan 12 is stopped (S3 and S4).

Preferably, the designated time (t) is a time required to allow the inner pressures of the compressor 2, the condenser 4, the expansion device 6 and the evaporator 8 to reach the equilibrium state.

Accordingly, since the outdoor fan 12 is operated for the designated time (t), although noise at a designated frequency band, which causes unpleasantness to users, is generated by the flow of the refrigerant from the compressor 2 and the condenser 4 to the expansion device 6 and the evaporator 8, this noise generated by the flow of the refrigerant is concealed by noise generated by the operation of the outdoor fan 12.

Now, operation of the outdoor fan 12 according to the stopped time of the compressor 2 will be described with reference to FIG. 4. When the air conditioner is operated, power is supplied to the compressor 2 and the outdoor fan 12, thus simultaneously operating the compressor 2 and the outdoor fan 12. On the other hand, when the air conditioner is stopped, the compressor 2 is immediately stopped, but the outdoor fan 12 is continuously operated during the designated time (t) and then stopped.

As apparent from the above description, the present invention provides a method for controlling noise reduction of an air conditioner, in which an outdoor fan is continuously operated for a designated time after a compressor is stopped, so as to rapidly reduce the pressure of a refrigerant passing through the condenser having a comparatively high inner pressure, thus reducing the size and duration of noise generated by the flow of the refrigerant due to a difference of inner pressures in a cooling cycle and allowing the noise at a designated frequency band generated by the flow of the refrigerant, which causes unpleasantness to users, to be concealed by noise generated by the operation of the outdoor fan. Accordingly, it is possible to increase reliability of air conditioner products.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method for controlling noise reduction of an air conditioner, the method comprising:

(a) stopping a compressor, when the air conditioner is stopped under the condition that the compressor and an outdoor fan are operated; and (b) stopping the outdoor fan after a designated time after a point in time when the compressor is stopped in the step (a) elapses;

wherein the designated time in the step (b) is a time required to allow inner pressures of the compressor, a condenser, an expansion device and an evaporator to reach an equilibrium state.

2. A method for controlling noise reduction of an air conditioner, the method comprising:

continuously operating an outdoor fan for a designated time after a compressor is stopped, so as to reduce temperature and pressure of a refrigerant passing through a condenser;

wherein the outdoor fan is stopped after the designated time from the stoppage of the compressor elapses;

wherein the designated time is a time required to allow inner pressures of the compressor, a condenser, an expansion device and an evaporator to reach an equilibrium state.

3. An air conditioner, comprising:

a compressor for compressing a refrigerant into a gaseous state;

a condenser for condensing the refrigerant passing through the compressor;

an expansion device for decompressing the refrigerant passing through the condenser;

an evaporator for evaporating the refrigerant passing through the expansion device; and an outdoor fan formed adjacent the evaporator for blowing outdoor air;

wherein the outdoor fan is operated for a predetermined time after the compressor is stopped so as to reduce temperature and pressure of a refrigerant passing through the condenser;

wherein the predetermined time is a time required to allow inner pressures of the compressor, the condenser, the expansion device and the evaporator to reach an equilibrium state.

4. The air conditioner of claim 3, wherein the operation of the outdoor fan when the compressor is stopped allows the refrigerant passing through the condenser to be heat-exchanged with outdoor air to reduce the inner temperature and pressure of the condenser.

* * * * *